US011358273B2

(12) United States Patent
Milani et al.

(10) Patent No.: US 11,358,273 B2
(45) Date of Patent: Jun. 14, 2022

(54) SUPPORT FOR TOOLS AND SUPPORT SYSTEM FOR TOOLS

(71) Applicant: FAMI S.R.L., Rosa' (IT)

(72) Inventors: Luca Milani, Rossano Veneto (IT); Lorenzo Frison, Fontaniva (IT)

(73) Assignee: FAMI S.R.L., Rosa' (IT)

( * ) Notice: Subject to any disclaimer, the term of this patent is extended or adjusted under 35 U.S.C. 154(b) by 0 days.

(21) Appl. No.: 17/173,450

(22) Filed: Feb. 11, 2021

(65) Prior Publication Data

US 2021/0370492 A1 Dec. 2, 2021

(30) Foreign Application Priority Data

May 28, 2020 (IT) ..... 102020000012709

(51) Int. Cl.
*B25H 3/04* (2006.01)
*A47F 5/08* (2006.01)

(52) U.S. Cl.
CPC ..... *B25H 3/04* (2013.01); *A47F 5/0823* (2013.01)

(58) Field of Classification Search
CPC ..... A47F 5/0823; B25H 3/04
See application file for complete search history.

(56) References Cited

U.S. PATENT DOCUMENTS

| | | | | |
|---|---|---|---|---|
| 3,265,032 | A | 8/1966 | Cleat | |
| 5,799,915 | A * | 9/1998 | Morey | A63C 11/028 248/201 |
| 6,575,313 | B1 * | 6/2003 | Chen | B25H 3/02 211/70.6 |
| 6,592,088 | B2 * | 7/2003 | Thompson | F16M 11/041 248/220.1 |
| 9,193,063 | B2 * | 11/2015 | Huang | F16B 2/14 |
| 10,629,335 | B2 * | 4/2020 | Rouleau | H01R 43/20 |
| 2007/0120021 | A1 * | 5/2007 | Lin | F16B 2/18 248/49 |
| 2013/0105655 | A1 | 5/2013 | Chen | |
| 2015/0251311 | A1 * | 9/2015 | Huang | F16B 21/04 211/70.6 |
| 2016/0126687 | A1 * | 5/2016 | Rouleau | B60R 16/0215 29/748 |
| 2016/0158662 | A1 | 6/2016 | Lee | |

FOREIGN PATENT DOCUMENTS

| | | |
|---|---|---|
| CN | 207126138 U | 3/2018 |
| EP | 3028756 A1 | 6/2016 |

* cited by examiner

*Primary Examiner* — Kimberley S Wright
(74) *Attorney, Agent, or Firm* — Pearne & Gordon LLP

(57) ABSTRACT

Support (1) for tools (U) comprising at least one modular component (2) comprising a main body (3) configured to realize a rest and/or a stop for a tool (U). The main body (3) is further configured to realize a reversible connection between the modular component (2) and one or more further modular components (2).

18 Claims, 10 Drawing Sheets

SUPPORT FOR TOOLS AND SUPPORT SYSTEM FOR TOOLS

The present invention relates to a support for tools and a support system for tools.

To date there are different types of supports connected or connectable to special walls or panels, usually perforated, in order to be able to realize a wall for tools. Generally, such perforated walls or panels have a standard type of drilling in which the holes have the dimensions 10 mm×10 mm and a 38 mm pitch between each hole.

Among the known supports there are various types, from those provided with special shapes to support a plurality of tools and/or special tools to generic ones, such as hooks, which allow to support only particular types of tools.

The term tool refers to any type of instrument/equipment such as, for example, and hereby providing a non-exhaustive list: hammers, scissors, shears, wrenches, ropes, pipes, pliers, screwdrivers and similar.

Therefore, given the variety of existing tools, a disadvantage of the known supports lies in the fact that they are designed for specific tools or that they cannot be used for a wide variety of tools, resulting in the purchase of specific hooks for each tool available and losing time finding the most suitable one.

In addition, the current hooks of the prior art are in some cases dedicated to specific tools (and not transferable to all types of tools) and thus have reduced flexibility since they are not adaptable to future ranges of tools not yet in production.

Further, the tools of the prior art can be bulky and/or expensive.

The technical task of the present invention is thus to make available a support for tools and a support system for tools which are able to overcome the prior-art drawbacks which have emerged.

An object of the present invention is therefore to provide a support for tools and a support system for tools which are versatile and usable for a wide variety of tools and which therefore favour reducing costs.

Furthermore, a further object of the present invention is to provide a support for tools and a support system for tools which are easily mountable and removable so as to result in a gain in time by a user.

The defined technical task and the specified aims are substantially achieved by a support for tools and a support system for tools comprising the technical features set forth in one or more of the appended claims.

In particular, the technical task and the objects specified are substantially achieved by a support for tools comprising at least one modular component. The modular component comprises a main body, defining a lateral wall and two base surfaces and extending from a first end to a second end. The main body is configured to realize a rest and/or a stop for a tool.

The main body is connectable to a wall or panel, preferably perforated walls or panels, according to a first fixing configuration, in which the base surfaces are parallel to the wall or panel, or a second fixing configuration in which the base surfaces are perpendicular to the wall or panel.

The main body is further configured to realize a reversible connection between the modular component itself and a further modular component.

Furthermore, the technical task and the specified aims are substantially achieved by a support system for tools comprising a plurality of supports for tools mentioned above, a wall or panel possibly perforated and a plurality of connection members configured to realize a reversible connection between one or more modular components of the supports for tools and the wall or panel so as to create a plurality of resting and/or stopping points for tools.

Advantageously, the support for tools and the support system for tools are versatile and can be used for a wide variety of tools.

Advantageously, the support for tools and the support system for tools are easily mountable and removable, leading to a gain in time for a user.

Further features and advantages of the present invention will become more apparent from the indicative and thus non-limiting description of an embodiment of a support for tools and a support system for tools.

This description will be set out below with reference to the appended drawings, which are provided solely for illustrative and therefore non-limiting purposes, in which.

With reference to the appended figures, 1 indicates in its entirety a support for tools which, for simplicity of description, will be referred to below as support 1. The term tool "U" refers to any type of instrument/equipment such as, for example and hereby providing a non-exhaustive list: hammers, scissors, shears, wrenches, ropes, pipes, pliers, screwdrivers and similar.

The support 1 comprises at least one modular component 2 comprising a main body 3.

Preferably, the modular component 2 can be made of plastic, composite, metallic or wood material.

Preferably, and as depicted for example in FIGS. 6 and 7, the support 1 can comprise two modular components 2 connected together in manners which will be described in the following of the present description.

Figure 1A:
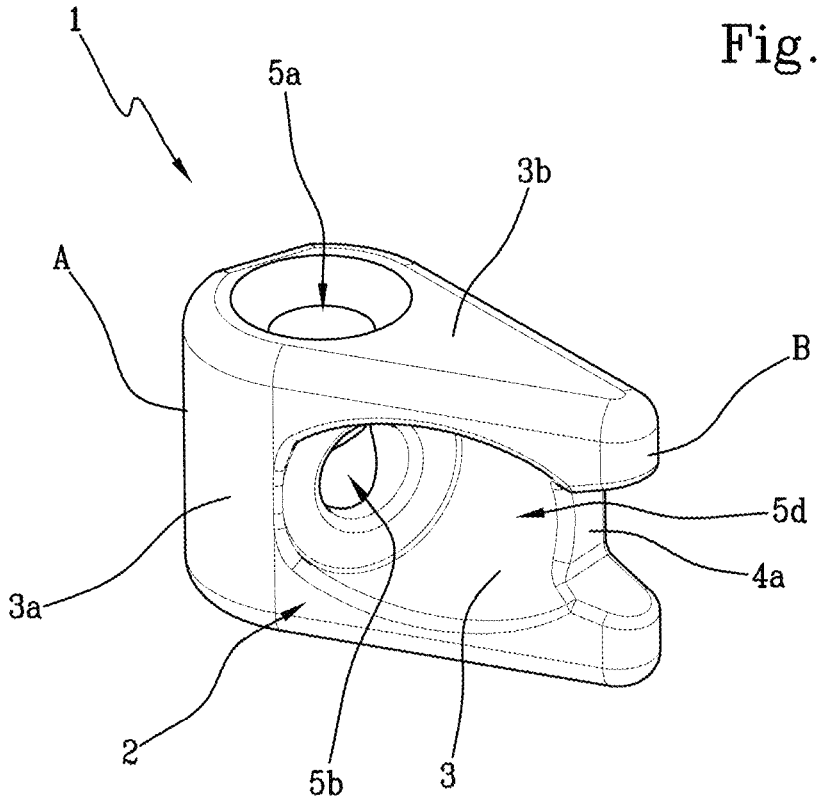
FIGS. 1A-7 are schematic depictions of different embodiments of the support for tools object of the present invention.

As depicted in FIG. 1A, the main body 3 defines a lateral wall 3*a* and two base surfaces 3*b*. The main body 3 extends from a first end "A" to a second end "B" with a substantially tapered shape. In other words, from the end "A" to the end "B" a transversal section of the main body 3 has a substantially decreasing trend. In the appended figures, the main body 3 has rounded edges but other shapes can be realized.

The main body 3, i.e., the first end "A", the second end "B" and the lateral walls are configured to realize a rest and/or a stop for a tool "U".

Figure 2:
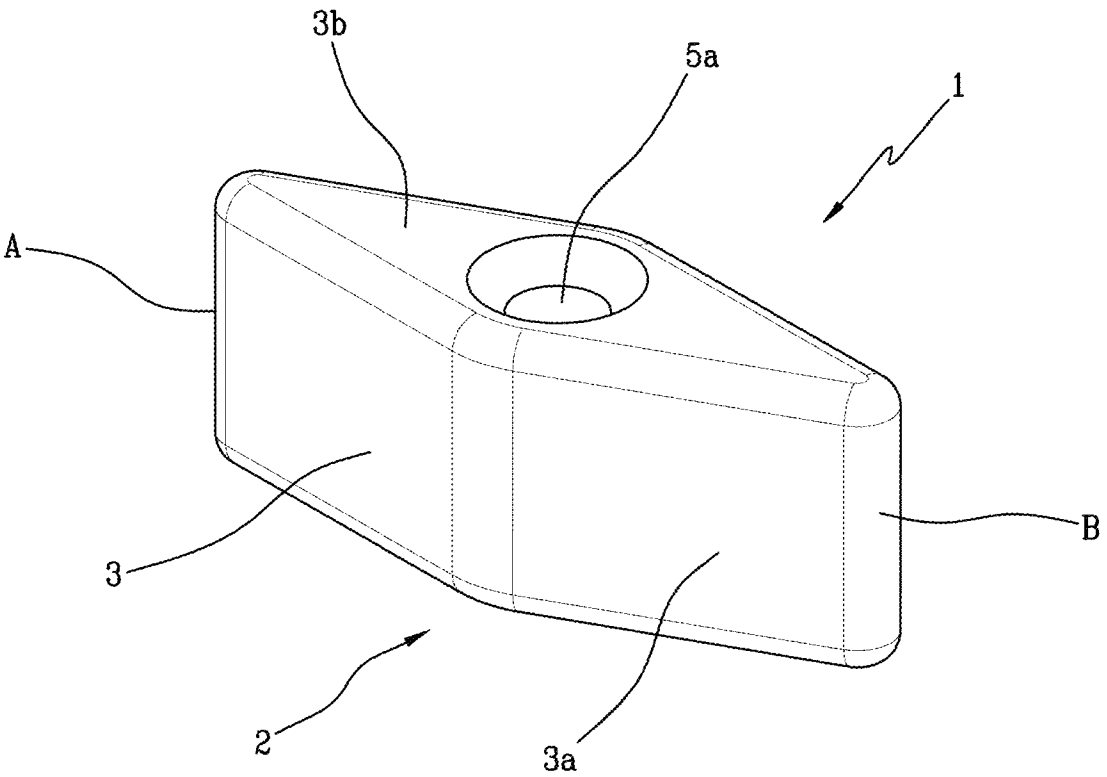

In a further embodiment, such as for example that of FIG. 2, the main body 3 (i.e., the base surfaces 3*b*) have a substantially rhomboidal shape.

Figure 4:
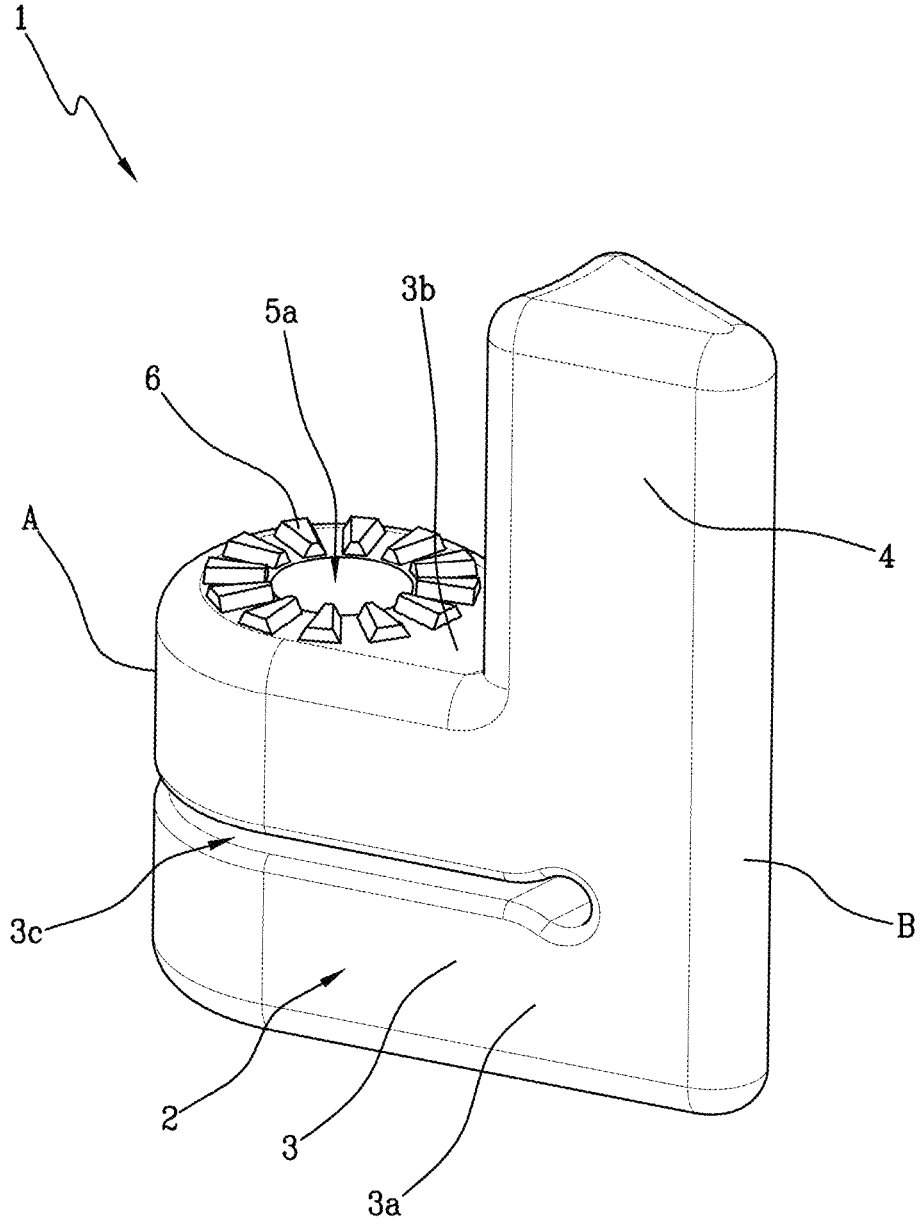
Figure 6:
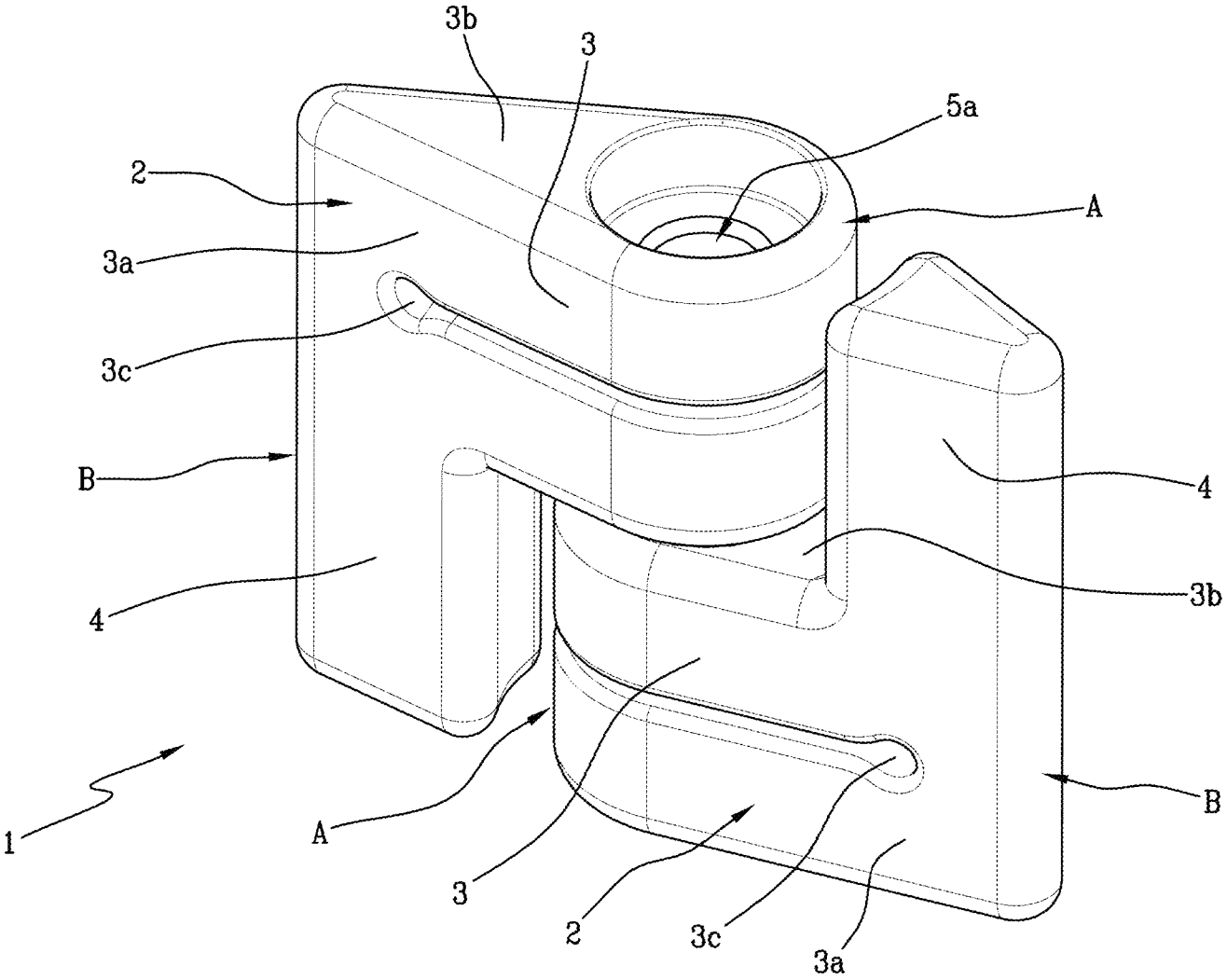

In a further embodiment, the main body 3 is provided with a transversal cut 3*c*, such as that shown in FIGS. 4 and 6. The transversal cut 3*c* is parallel to the base surfaces 3*b* and extends in a region of the main body 3 near the first end "A". Advantageously, the transversal cut 3*c* allows to increase the elasticity of the modular component 2.

The main body 3 is further connectable with a wall or panel "P", preferably a perforated wall or panel "P". Generally, such perforated walls or panels "P" have a standard type of drilling in which the holes have the dimensions 10 mm×10 mm and a 38 mm pitch between each hole. However, other embodiments of the walls or panels "P" are achievable, such as walls or panels "P" provided with round holes. Preferably, the main body 3 is connectable to the wall or panel "P" at the end "A" or at one of the base surfaces 3*b*

In particular, the main body 3 is connectable to a wall or panel "P" according to a first fixing configuration, in which the base surfaces 3*b* are parallel to the wall or panel "P", or a second fixing configuration in which the base surfaces are perpendicular to the wall or panel "P".

In the first fixing configuration, the main body 3 rests on the wall or panel "P" through the base surface 3*b*, while in the second fixing configuration the main body 3 rests on the wall or panel P through the end "A".

Preferably, and as depicted in the appended figures, the main body 3 is provided with an axial fixing hole 5*a* extending between the two base surfaces 3*b*.

Preferably, as depicted in FIG. 1A, the axial fixing hole 5*a* extends at the first end "A".

Figure 1B:
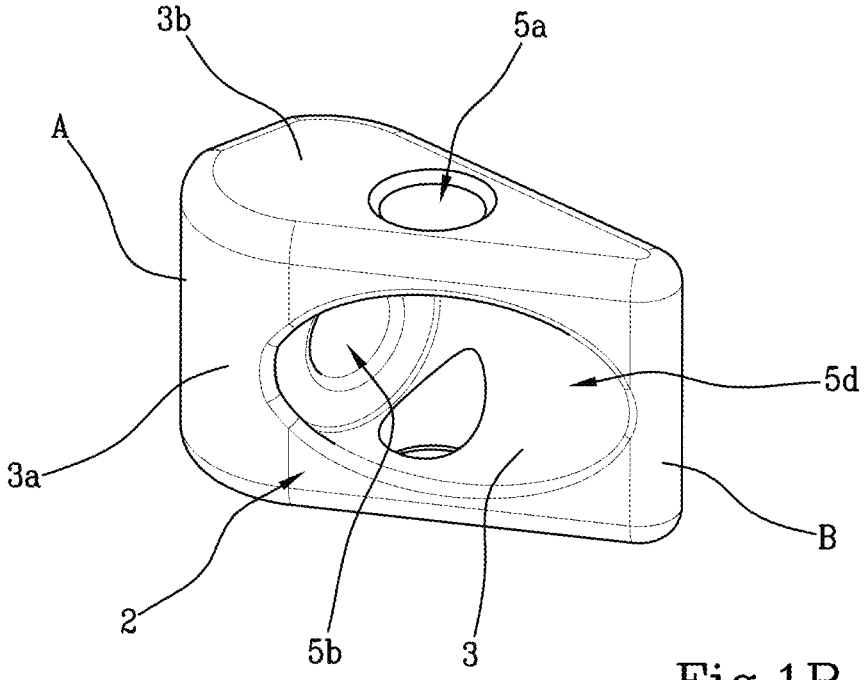

Preferably, as depicted in FIGS. 1B and 2, the axial fixing hole 5*a* extends in a central portion of the main body 3.

Figure 8A:
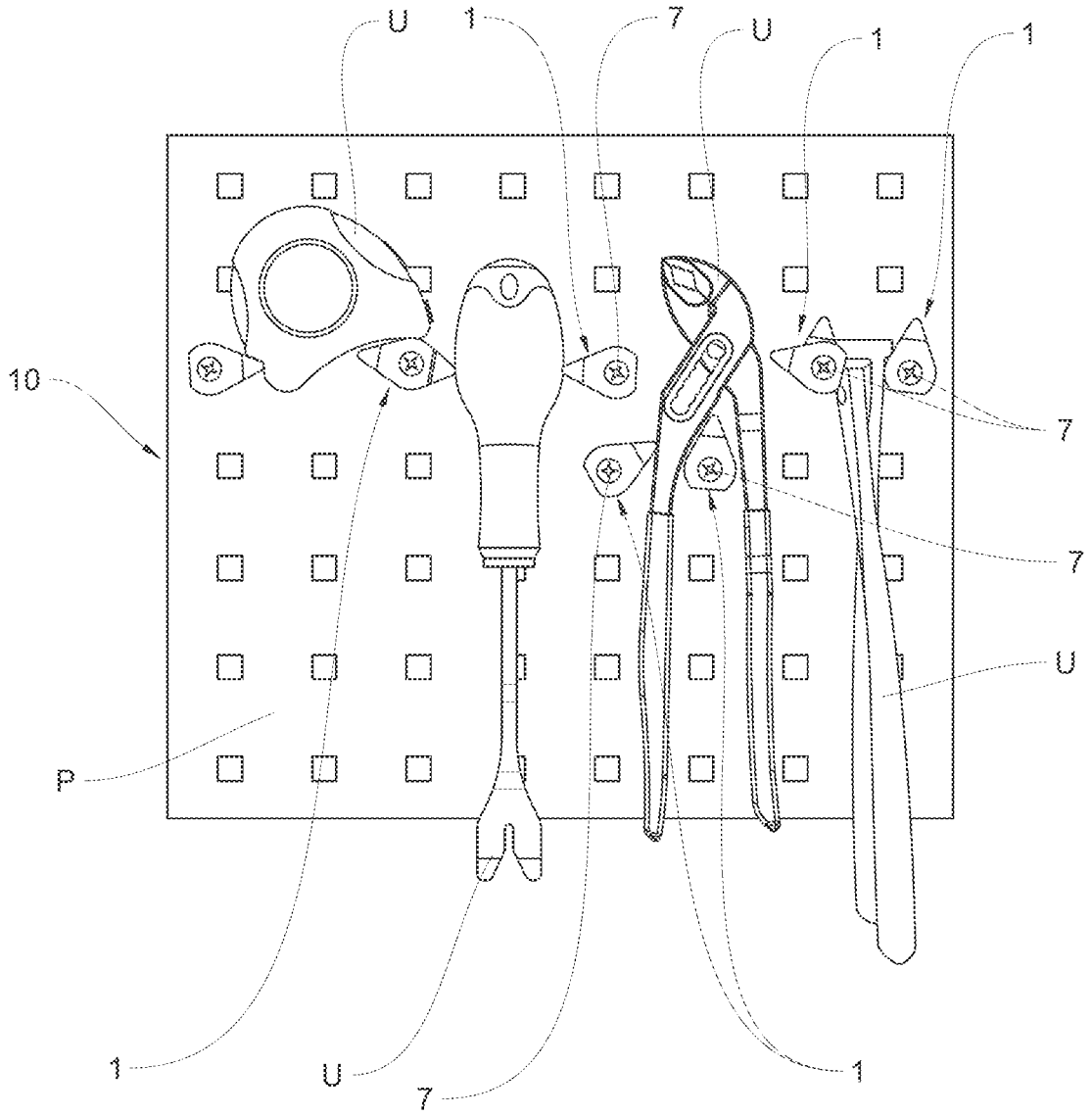
FIGS. 8A-8C are exemplary depictions of a support system for tools object of the present invention.

The axial fixing hole 5*a* is configured to allow the connection of the main body 3 to the wall or panel "P" according to the first fixing configuration, such as for example shown in FIG. 8A. Such a fixing can be accomplished by means of a connection member 7, such as a screw, clip, insert, expansion rivet or other similar means.

Preferably, the main body 3 is provided with a front fixing hole 5*b* extending parallel to the two base surfaces and configured to allow the connection of the main body 3 to the wall or panel "P" according to the second fixing configuration.

Preferably, the main body 3 can be provided with both the axial fixing hole 5*a* and the front fixing hole 5*b*. In this configuration, the front fixing hole 5*b* can extend according to an extension axis thereof, extending between the first end "A" and the second end "B" and perpendicularly intersecting the axial fixing hole 5*a*.

In this particular embodiment, the main body 3 can be provided with an opening 5*d* suitable for allowing the passage of a connection member to connect the main body 3 to the wall or panel "P". This conformation is what allows maximum versatility to be obtained from the support 1 itself.

Figure 5:
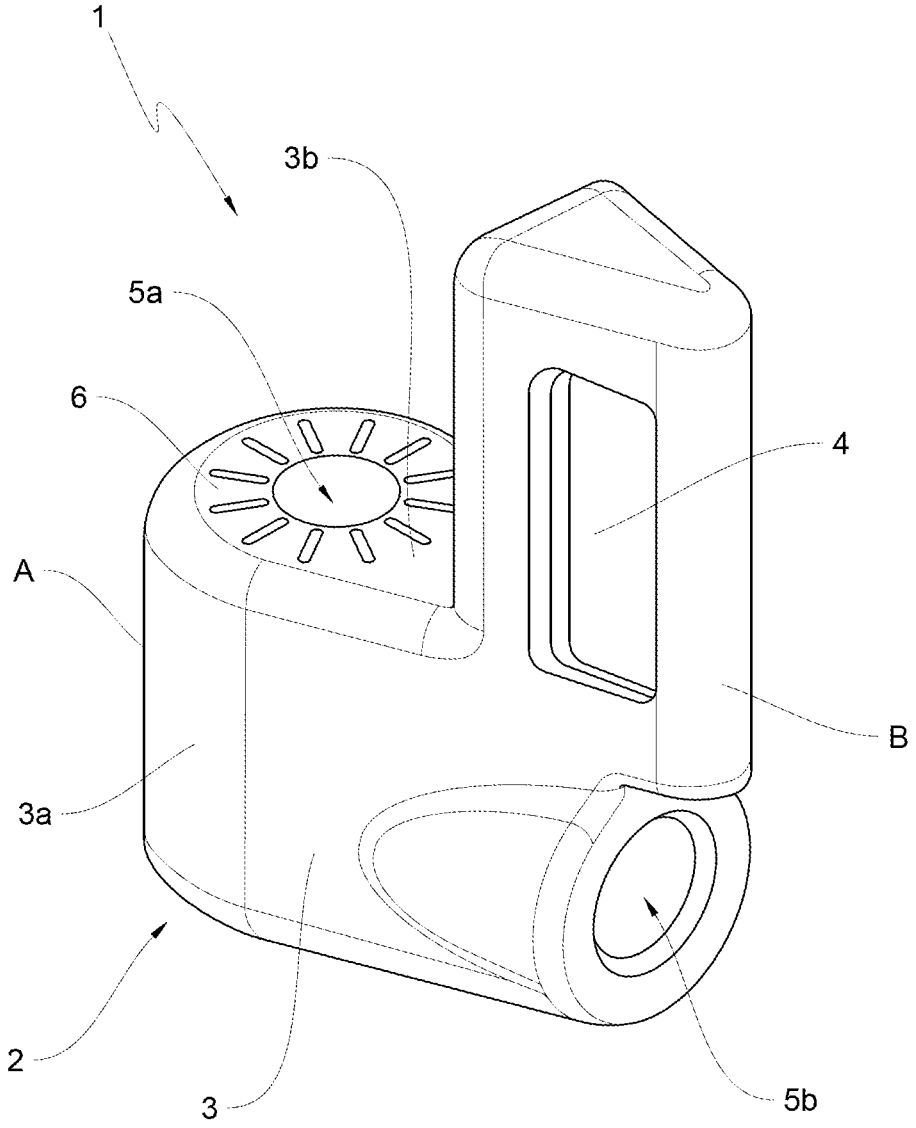

Alternatively, such as for example depicted in FIG. 5, the hole 5*b* can be arranged in the second end "B" and therefore extends for the entire extension of the main body 3.

Alternatively, the front fixing hole 5*b* can extend near the axial fixing hole 5*a* (therefore not intersecting it) so as to obtain a versatility similar to that of the previously described case.

Preferably, the lateral surface 3*a* of the main body 3 has, near the first end "A", a resting surface 5*c* to the wall or panel "P" from which an end of the front fixing hole 5*b* opens. Such a resting surface 5*c* allows to obtain a stable resting of the main body 3 on the wall or panel "P" thus avoiding unwanted movements once it is fixed to the wall or panel "P" (for example by means of the aforementioned connection members 7).

Figure 7:
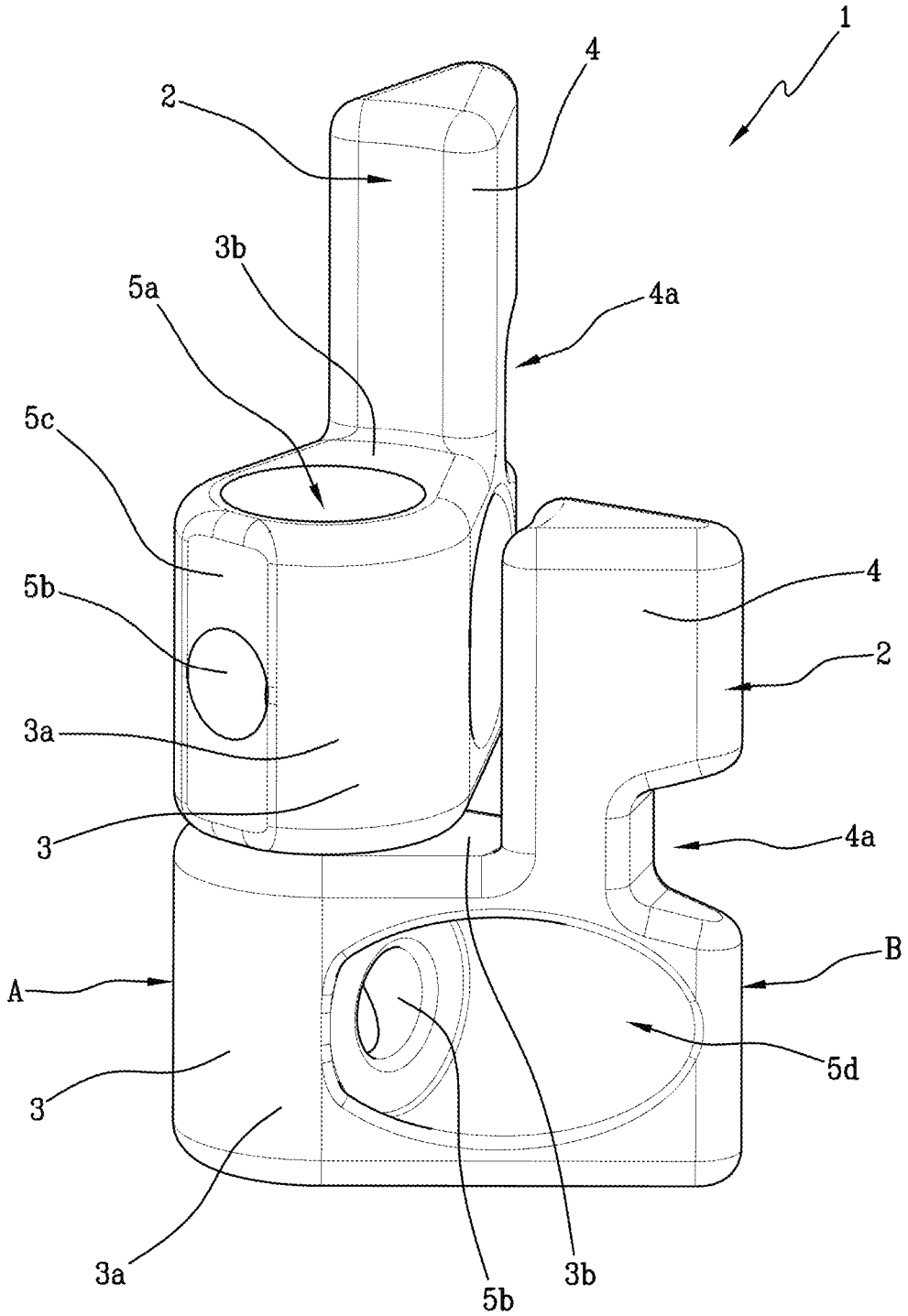
Figure 8B:
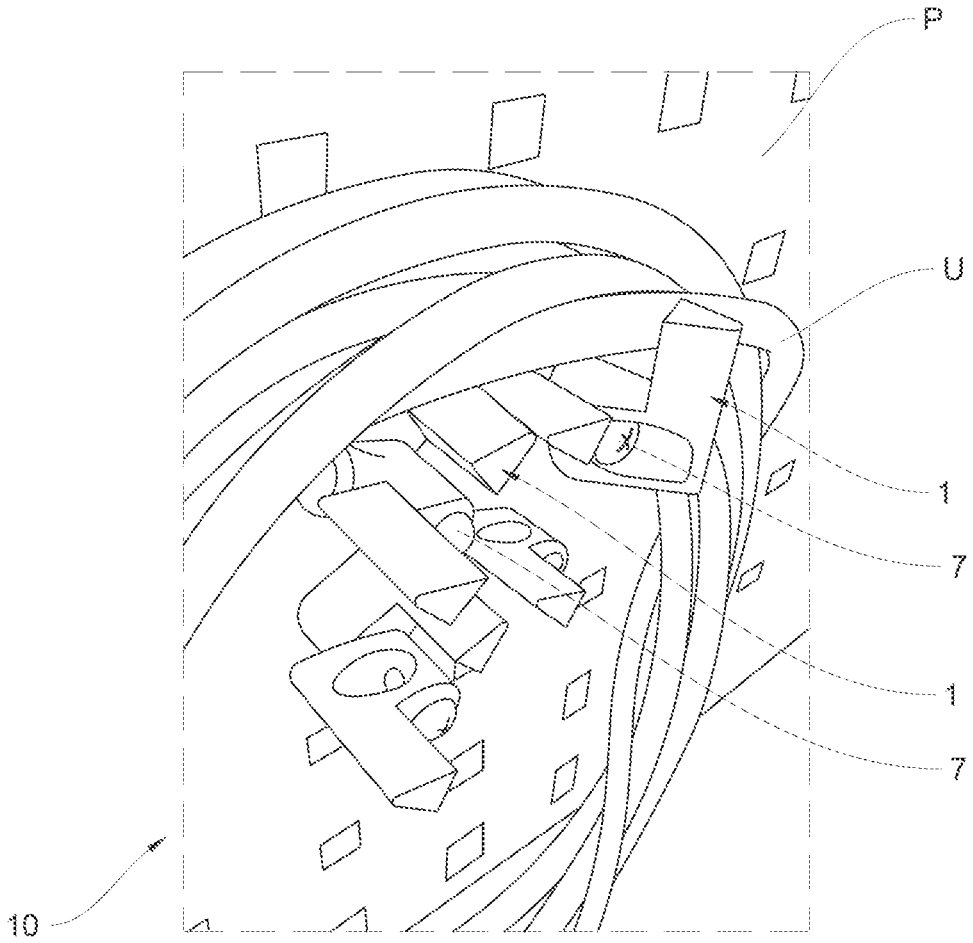

The main body 3 is further configured to realize a reversible connection between the modular component 2 itself and a further modular component 2 such as, for example, depicted in FIGS. 6 and 7. A further reversible connection is illustrated in FIG. 8B where one modular component 2, positioned axially, is connected with another modular component positioned frontally. That is, the resting surface 5*c* of the second modular element 2 is placed in contact with, and constrained by, the base surface 3*b* crossed by the axial fixing hole 5*a*.

Preferably, the axial fixing hole 5*a* is further configured to define the connection for the further modular component 2 by means of a connection member 7 passing through both axial fixing holes 5*a* of both modular components 2. The connection member 7 also allows to avoid unwanted movements between the modular components 2 once they have been connected to the wall or panel "P" and once the tool "U" has been positioned.

Figure 8C:
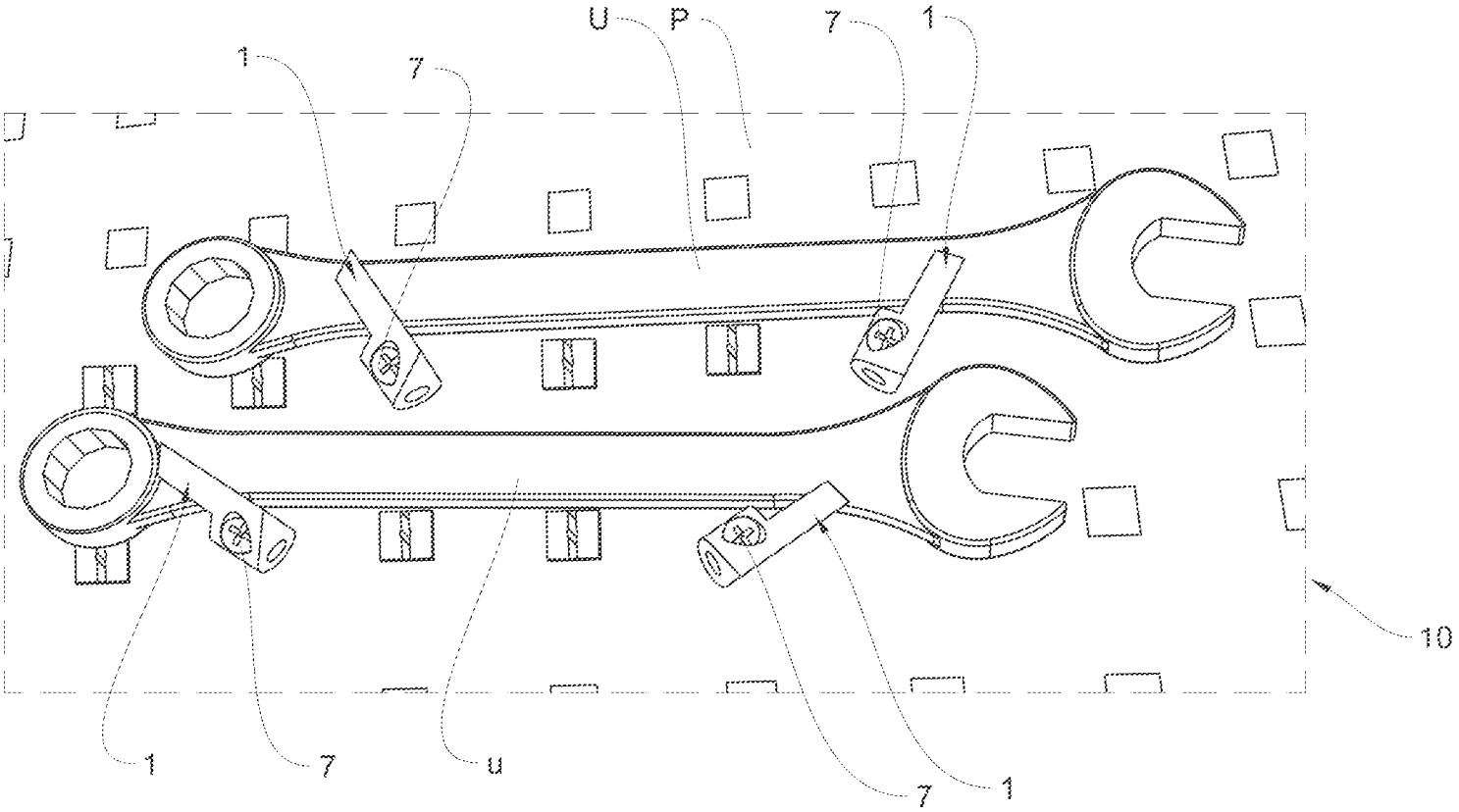

Preferably, the modular component 2 and the further modular component 2, when connected, can be placed in relative rotation so as to obtain a plurality of resting and/or stopping configurations for specific tools "U". That is, depending on where the individual supports 1 on the wall or panel "P" and the specific tools "U" to be supported are connected, the modular components 2 are configured differently in order to hold resting and/or stopping the specific tools "U" to which they will be associated, such as for example depicted in FIGS. 8A-8C.

In a possible embodiment, the modular component 2 and the further modular component 2 are provided with adjusting teeth 6 (such as for example shown in FIG. 4) configured to snap adjust the relative angle between the two modular components 2. That is, the presence of the adjusting teeth 6 allows to obtain predefined or in any case more stable resting and/or stopping configurations (thus avoiding possible unwanted rotations of the modular components 2 if the connection members 7 are not sufficient).

Preferably, both modular components 2 are provided with adjusting teeth 6 so as to define a toothed crown for adjusting the relative rotation between the modular components 2.

The adjusting teeth 6 can be placed on one of the two base surfaces 3*b* and arranged around the axial fixing hole 5*a*. Even more preferably, with reference to and as depicted in FIG. 4, the adjusting teeth 6 can be arranged on the upper base surface 3*b*.

Such as for example depicted in the embodiments of FIGS. 3-7, the modular component 2 can further comprise a support body 4.

The support body 4 is arranged at the second end "B" and extends away from one of the base surfaces 3*b* (in FIG. 3 such a base surface 3*b* is the upper one and visible in the figure itself) and is configured to realize a further rest and/or a stop for a tool "U". Preferably, the support body 4 realizes such a rest and/or stop in communion with the lateral wall 3*a* and/or the base walls 3*b* of the main body 3.

Figure 3:
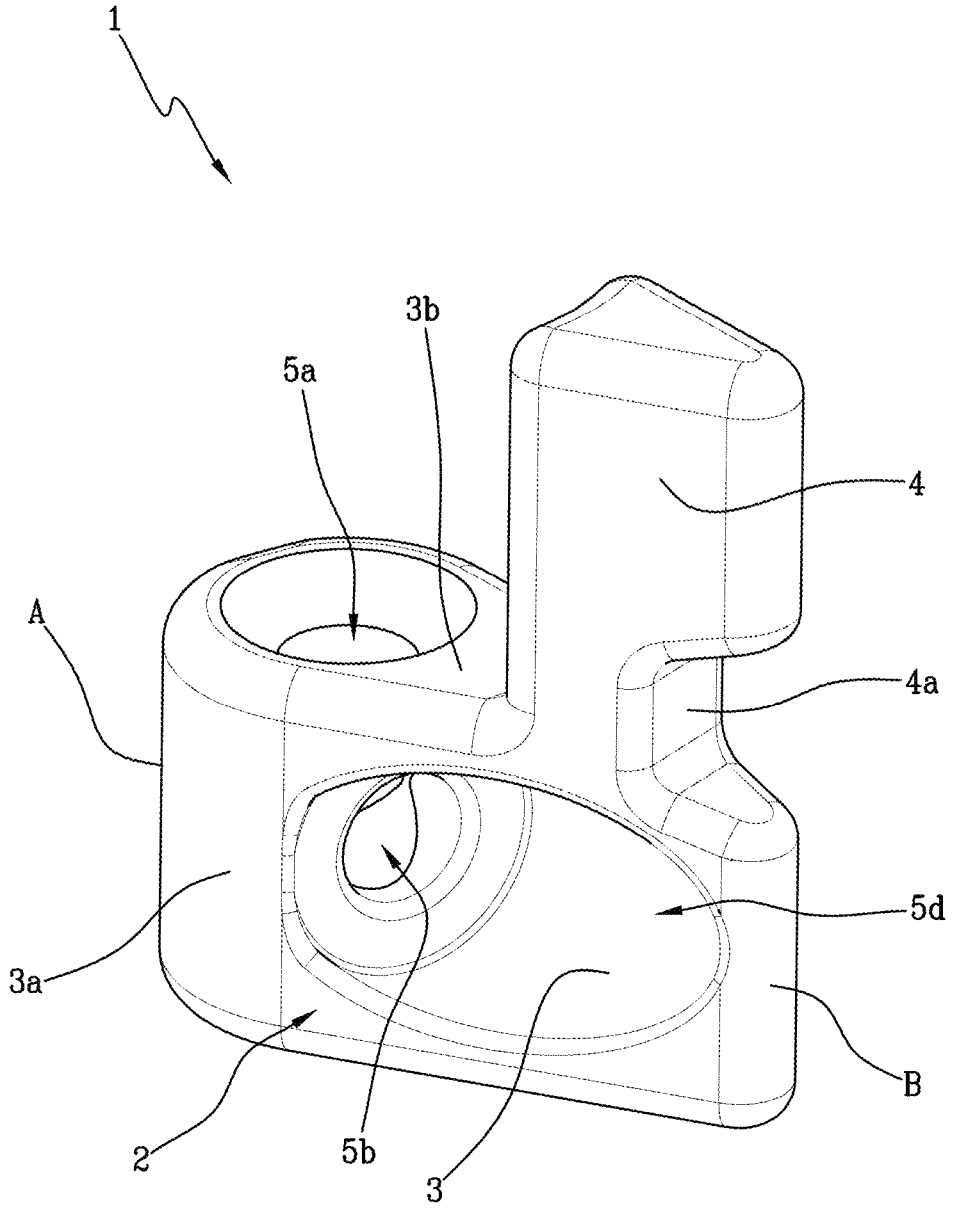

Preferably, such as for example depicted in FIGS. 3 and 7, the support body 4 defines an edge of the modular component 2 and is provided with one or more gaps 4*a* configured to contain the tools "U". For example, the gaps 4*a* of two supports 1 installed close to each other on the wall or panel "P" can define a seat intended to accommodate and retain a tool "U", such as a screwdriver, blocking it by the handle.

Although depicted in two different embodiments, the gap 4*a* and the transversal cut 3*c* described above can be realized in the same embodiment of the modular component 2 as those described above.

When the main body 3 is connected to the wall or panel "P" according to the first fixing configuration (in which the main body 3 is connectable to the wall or panel "P" at the base surface 3*b* from which the support body 4 does not extend), the support body 4 is perpendicular to the wall or panel "P" (in other words, the support body 4 is parallel to the normal position of the wall or panel "P").

When the main body 3 is connected to the wall or panel "P" according to the second fixing configuration, the support body 4 is parallel to the wall or panel "P".

Preferably, the modular component 2 and the further modular component 2 (when connected through the axial fixing hole 5*a*) can be connected with a first mounting configuration in which the respective support bodies 4 extend away from the main bodies 3 with the same direction, such as for example depicted in FIG. 7.

Alternatively, the modular component 2 and the further modular component 2 (when connected through the axial fixing hole 5*a*) can be connected with a second mounting configuration in which the respective support bodies 4 extend away from the main bodies in the opposite direction, as depicted in FIG. 6.

Further, the modular component 2 and the further modular component 2 can be connected in a third mounting configuration in which the respective support bodies 4 are positioned with a perpendicular and incident arrangement. In this configuration the axial fixing hole 5*a* is further configured to define the connection for the further modular component 2 by means of a connection member 7 passing through the axial fixing hole 5*a* itself and the front fixing hole 5*b* of the further modular component 2 (such as for example depicted in FIG. 8B).

The choice of one of the mounting configurations is arbitrary as a function of the specific tool "U" to be supported and allows to obtain additional resting and/or stopping configurations.

The choice to use a single modular component 2, or to use one or the other connection configuration of two or more modular components 2, as well as the possibility of connecting to the wall or panel "P" according to the first or second fixing configuration, as well as the choice of the mounting configuration and the relative angle between one and the other modular component 2 allow to define a plurality of resting and/or stopping configurations which allow to cover a wide variety of tools "U" to be supported.

Advantageously, both in the case of a support 1 provided with a single modular component 2 and in the case of a support 1 provided with both modular components 2, it is possible to obtain a rapid movement and therefore a rapid configuration of the support 1 without the need to completely remove the connection member 7. For example, if the connection member 7 is a screw coupled to a removable expansion plug, it will not be necessary to completely unscrew the screw, allowing the undercut between the wall or panel "P" and the plug itself to be freed so that the user can hold the support 1 completely in his/her hand and move it where he/she most prefers easily.

In the case of modular elements 2, coupled together, it is possible to obtain the relative rotation between two modular elements mounted overlapping by loosening the fixing member 7 and locking it again once the desired new orientation between the first and second elements has been obtained.

Furthermore, in the case of modular elements 2 coupled together and provided with a transversal cut 3*c*, the relative rotation of the two modular elements mounted overlapping can be obtained without loosening the fixing member 7, by exploiting the elasticity of the elements.

The present invention also relates to a support system 10 comprising a plurality of supports 1 as previously described (and therefore defined by one or more modular components 2 and by the different mounting or fixing configurations to the wall or panel "P", etc.).

The support system 10 is also provided with a wall or panel "P". Preferably, the wall or panel "P" can be perforated. Even more preferably, the wall or panel can be provided with a standard type of drilling in which the holes have the dimensions 10 mm×10 mm and a 38 mm pitch between each hole. However, other embodiments of the walls or panels "P" are achievable, such as for example walls or panels "P" provided with round holes, or wooden or plastic walls without holes on which to fix the supports with self-tapping screws.

The support system 10 further comprises a plurality of connection members 7 configured to realize a reversible connection between one or more modular components 2 of the supports 1 for tools "U" and the wall or panel "P" so as to realize a plurality of resting and/or stopping points for tools "U". Preferably, the connection members 7 can be selected from a screw, a clip, an insert, an expansion rivet or other similar means.

Advantageously, the present invention is able to overcome the drawbacks which have emerged from the prior art.

Advantageously, the support 1 for tools "U" and the support system 10 for tools "U" are versatile and can be used for a wide variety of tools "U" as a function of the different configurations described above.

Advantageously, the support 1 for tools "U", as well as the support system 10 for tools "U", are easily mountable and removable, leading to a gain in time for a user.

The invention claimed is:

1. A support (1) for tools (U) comprising at least one modular component (2) comprising a main body (3), defining a lateral wall (3*a*) and two base surfaces (3*b*) and extending from a first end (A) to a second end (B) configured to realize a rest and/or a stop for a tool (U), said main body (3) being connectable to a wall or panel (P) according to a first fixing configuration, wherein said base surfaces (3*b*) are parallel to the wall or panel (P), or a second fixing configuration wherein said base surfaces are perpendicular to said wall or panel (P);

said main body (3) being further configured to realize a reversible connection between said modular component (2) and one or more further modular components (2);

wherein said main body (3) is provided with an axial fixing hole (5*a*), extending between said two base surfaces (3*b*) and configured to allow the connection of said main body (3) to said wall or panel (P) according to said first fixing configuration;

wherein said main body (3) is further provided with a front fixing hole (5*b*) extending parallel to said two base surfaces (3*b*) and configured to allow the connection of said main body (3) to said wall or panel (P) according to said second fixing configuration.

2. The support (1) according to claim 1, wherein said base surfaces have a substantially rhomboidal shape.

3. The support (1) according to claim 1, wherein said main body extends from said first end to said second end with a substantially tapered shape.

4. The support (1) according to claim 1, wherein said modular component further comprises a support body (4), arranged at said second end (B) and extending away from one of said base surfaces (3*b*) of the main body (3), configured to realize a further rest and/or a stop for a tool (U), said support body being perpendicular to said wall or panel (P) when said main body (3) is connected according to the first fixing configuration and being parallel to said wall or panel (P) when said main body (3) is connected according to the second fixing configuration.

5. The support (1) according to claim 1, wherein said main body (3) is further provided with a front fixing hole (5*b*) extending parallel to said two base surfaces (3*b*) and configured to allow the connection of said main body (3) to said wall or panel (P) according to said second fixing configuration, and wherein said front fixing hole (5*a*) extends according to an extension axis thereof extending between said first and second ends (A, B) and intersecting perpendicularly said axial fixing hole (5*a*), said lateral surface (3*a*) of the main body (3) having, near the first end (A), a resting surface (5*c*) to said wall or panel (P) from which an end of the front fixing hole (5*b*) opens.

6. The support (1) according to claim 1, wherein said axial fixing hole (5*a*) is further configured to define said connection for the further modular component (2) by means of a connection member (7) passed through both axial fixing holes (5*a*) of both modular components (2).

7. The support (1) according to claim 6, wherein said modular component (2) and said further modular component (2), when connected, can be placed in relative rotation so as to obtain a plurality of resting and/or stopping configurations for specific tools (U).

8. The support (1) according to claim 7, wherein at least one of said modular component (2) and said further modular component (2) is provided with adjusting teeth (6) configured to snap adjust the relative angle between the two modular components (2).

9. The support (1) according to claim 4, wherein said main body (3) is provided with an axial fixing hole (5*a*), extending between said two base surfaces (3*b*) and configured to allow the connection of said main body (3) to said wall or panel (P) according to said first fixing configuration, wherein said axial fixing hole (5*a*) is further configured to define said connection for the further modular component (2) by means of a connection member (7) passed through both axial fixing holes (5*a*) of both modular components (2), and wherein said modular component (2) and said further modular component (2) can be connected with a first mounting configuration, wherein the respective support bodies (4) extend away from the main bodies (3) in the same direction, or with a second mounting configuration, wherein the respective support bodies (4) extend away from the main bodies (3) in the opposite direction.

10. The support (1) according to claim 1, wherein the axial fixing hole (5*a*) is further configured to define said connection for the further modular component (2) by means of a connection member (7) passing through the axial fixing hole (5*a*) itself and the front fixing hole (5*b*) of the further modular component (2).

11. The support (1) according to claim 3, wherein said main body (3) has at said first or second end or at a support body (4) one or more gaps (4*a*) configured to contain the tools (U).

12. The support (1) according to claim 1, wherein said main body is provided with a transversal cut (3*c*), parallel to said base surfaces (3*b*), extending near said first end (A) of the main body (3); said transversal cut (3*c*), in the case of connection of two or more modular components (2), favouring the relative rotation of one modular component (2) with respect to another without loosening the grip of a connection member (7).

13. A support system (10) for tools (U) comprising a plurality of supports (1) for tools (U) according to claim 1, a wall or panel (P) and a plurality of connection members (7) configured to realize a reversible connection between one or more modular components (2) of the supports (1) and the wall or panel (P) so as to create a plurality of resting and/or stopping points for tools (U).

14. The support (1) according to claim 1, wherein said wall or panel (P) is a perforated wall or panel (P).

15. The support (1) according to claim 1, wherein said axial fixing hole (5*a*) is in said first end (A).

16. The support (1) according to claim 8, wherein both modular components (2) are provided with said adjusting teeth (6) defining a toothed crown for adjusting the relative rotation between the modular components (2).

17. The support (1) according to claim 9, wherein said axial fixing hole (5*a*) is in said first end (A).

18. The support system (10) according to claim 13, wherein said wall or panel (P) is a perforated wall or panel (P).

* * * * *